United States Patent [19]

Hilton

[11] 4,098,538

[45] Jul. 4, 1978

[54] EARTH WORKING MACHINE HAVING INDEPENDENT TOOLS AND ROOF ENGAGING BRIDGE

[75] Inventor: Allan Richard Hilton, Heaton, England

[73] Assignee: Mining Developments Limited, Bolton, Great Britain

[21] Appl. No.: 787,179

[22] Filed: Apr. 13, 1977

[30] Foreign Application Priority Data

Apr. 14, 1976 [GB] United Kingdom ..... 15342/76

[51] Int. Cl.[2] ..... E21C 33/00

[52] U.S. Cl. ..... 299/33; 173/35; 173/46

[58] Field of Search ..... 299/31, 33

[56] References Cited

U.S. PATENT DOCUMENTS 1,290,021 12/1918 Levin ..... 299/33 X 1,321,427 11/1919 Fisher ..... 299/33 X 1,755,332 4/1930 Morgan ..... 299/33

FOREIGN PATENT DOCUMENTS 1,433,756 4/1976 United Kingdom ..... 299/33

*Primary Examiner*—Ernest R. Purser

*Attorney, Agent, or Firm*—Sughrue, Rothwell, Mion, Zinn and Macpeak

[57] ABSTRACT

A mobile earth working machine has a tracked base on which various tools such as an impactor hammer and a side delivery bucket are mounted on separate booms.

To permit two or more tools to be used simultaneously, while tunnelling, a locking or clamping arrangement is provided on the machine which is operational when the machine is stationary and braked to clamp to machine between floor and roof. The locking arrangement is a bridge structure preferably mounting three ram-movable clamp plates.

5 Claims, 3 Drawing Figures

EARTH WORKING MACHINE HAVING INDEPENDENT TOOLS AND ROOF ENGAGING BRIDGE

This invention relates to a mobile earth working machine for use under ground in mines or in the creation of tunnels.

In mining or tunnelling it is firstly necessary to win the material from the work face and then to transfer the won material out of the path of the earth working machine.

A mobile earth working machine has been proposed which incorporates on separate booms a tool by which material is won and also a side or forward dump bucket for removing the won material from the path of the earth working machine. However, a major disadvantage of such machines is that the earth winning tool and side dump bucket cannot be used simultaneously and it is an object of the present invention to overcome this disadvantage.

According to the present invention, there is provided a mobile earth working machine comprising on a plurality of separate booms earth working tools and means operable when the machine is stationary and braked to lock the machine vertically between floor and ceiling.

It is considered that with the mobile earth working machine thus locked, it will be possible for the simultaneous operation of the tools which may be an earth winning tool and a side or forward material transfer bucket.

A further tool which may be carried by the machine is one for handling and positioning roof supports or props. Such tool is most likely to be used in the case where the machine is operating in a tunnel or underground roadway drivage would necessitate roof supporting. In this instance, this tool, with the machine vertically locked, could be used with the earth working tool and/or the bucket.

The earth working tool may be an impactor hammer or drilling machine.

The vertical locking means is preferably a bridge structure, preferably movable between substantially horizontal or vertical positions, and carrying at least one extensible plate or the like for engaging the roof.

The plate is preferably carried by a fluid-operated ram which clamps it against the roof.

There are preferably three side-by side fluid ram-operated plates.

The bridge structure may be permanently mounted in a vertical attitude on the machine.

There may be a single centrally-disposed fluid ram-operated plate on the bridge structure.

The mobile earth working machine is preferably a self-advancing vehicle, such as a tracked vehicle.

The present invention provides a machine for use in tunnelling and underground mine roadway construction which allows tools to be advanced to the required working position, the machine then to be stopped, braked and locked vertically between floor and ceiling, and as a consequence of the latter the simultaneous operation of two or more tools.

An embodiment of the present invention will now be described, by way of example, with reference to the accompanying drawings, in which.

The earth working machine is a tracked vehicle 5 carrying an electro-hydraulic power pack generally indicated at 6 and protected by a pivotal rear shield 7, and through which an operator with appropriate and well known controls 8 can move the vehicle in the direction he requires, operate the locking bridge structure and also the various tools.

Such vehicles, power packs and controls are all very well known to those skilled in the present art and consequently it is not considered essential to provide detailed descriptions thereof.

A modification of the above short general description of the earth working machine is to locate the electro-hydraulic power pack remote from the vehicle and to interconnect them by umbilical hoses and cables. This would permit the operator to work at a convenient and/or safe distance from the work face.

Figure 1:
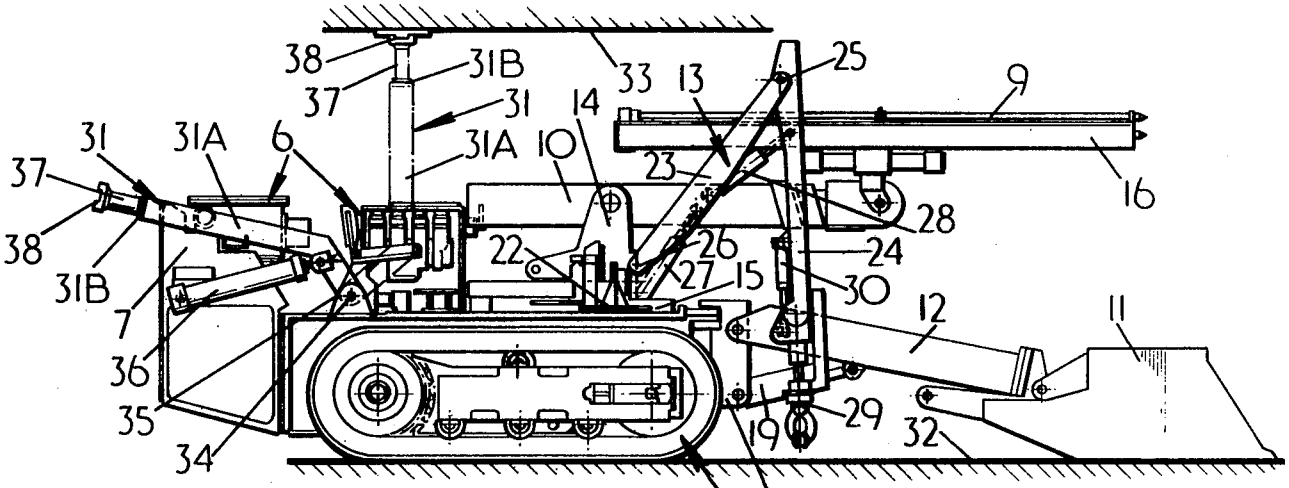
FIG. 1 is a side view of an earth working machine according to the present invention.
Figure 2:
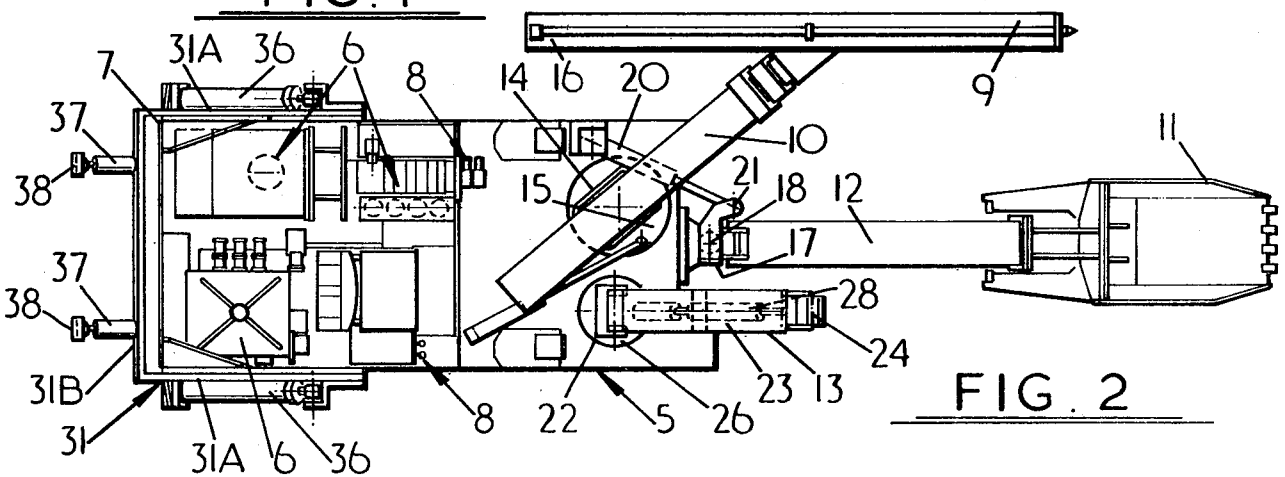
FIG. 2 is a corresponding plan view.

Referring now particularly to FIGS. 1 and 2, there is mounted on the tracked vehicle 5 a drill 9 carried by a boom 10, a forward dump bucket 11 carried by a boom 12 and a roof-support handling tool 13.

The boom 10 is hydraulically extensible as is usual to permit the drill 9 to be moved to the desired location and is carried in a cradle structure 14 mounted on a turntable 15. The boom 10 carries a platform 16 on which the drill 9 is rotatably supported and relative to which the drill 9 is movable to effect winning of the earth strata. When not in use, the drill 9 can be moved back as seen in FIG. 2 to lie substantially alongside the vehicle 5.

The boom 12 is carried by a bracket structure 17 pivoted at 18 on the front of the vehicle 5, there being a hydraulic ram 19 between the bracket structure 17 and boom 12 to effect vertical movements of the bucket 11 and a hydraulic ram 20 between a side of the vehicle 5 and a lever 21 of the bracket structure 17 to permit lateral pivoting of the bucket 12. Rams (not shown) also permit the bucket 11 to swivel relative to the boom 12.

The roof support handling tool 13 is mounted on a turntable 22 and comprises a pair of arms 23, 24 hinged together at 25 with the bottom arm 23 pivotally mounted on the turntable 22 as indicated at 26. Hydraulic rams 27, 28 permit respectively vertical pivoting of the arms 23, 24 relative to the turntable 22, and relative pivoting between the arms 23, 24. The arm 24 at its free end has pivoted thereto a hydraulically-operated grappling head 29 for handling and positioning the roof supports in erected attitude, there being a hydraulic ram 30 to effect pivotal movement between the arm 24 and grappling head 29.

The three tools described above are all well known in themselves as is their operation to those skilled in the present art and will not therefore be described further or in greater detail since per se they do not constitute part of the present invention.

The present invention is concerned with moving these tools to a working location and then allowing them or any two of them to be operated simultaneously which has not been possible hitherto.

This is now rendered possible by providing on the vehicle 5 a bridge structure 31 which, when in a vertical attitude (FIG. 1), permits the stationary or braked vehicle 5 to be locked between the floor 32 and roof 33.

The bridge structure 31 comprises two arms 31A interconnected by a crossbar 31B. The arms 31A are pivotted at 34 to brackets 35 fixed on the vehicle 5 and are movable (see FIG. 1 especially) from a substantially horizontal out-of- use position to a vertical attitude by a pair of hydraulic rams 36 connected between the arms 31A and the shield 7. The crossbar 31B carries two side-by-side hydraulic rams 37 each of which carries a plate 38.

When the vehicle 5 is correctly positioned for working and is stopped and braked, the bridge structure 31 is pivoted to the vertical attitude and the rams 37 operated to pressure abut the plates 38 against the roof 33 and so vertically lock the vehicle 5 in the selected position.

It should be noted that for obvious safety reasons there is a suitable interlock between the hydraulic rams 36, 37 and the drive of the vehicle 5 so that the rams can only be operated to erect the bridge structure 31 and pressure abut the plates 38 against the roof 33 when the vehicle 5 is stopped and braked.

With the plate pressures abutted against the roof, and the vehicle stationary and braked, it is considered that there is sufficient resistance to prevent movement of the vehicle when both or all three tools are being operated simultaneously.

The bridge structure 31, rams 37 and plates 38 may additionally be employed to post-stress or load roof supporting arches or similar permanent supports. This is done by locating the machine under an arch, pivoting the bridge structure 31 to the vertical attitude and, by means of rams 37, urging the plates 38 against the arch and consequently the arch against the roof. This ensures permanent surface contact of the arch with the roof rather than point contact and minimises convergence between arches.

If necessary, friction plates or the like can be introduced under the bottom of the arch legs before release of the rams 37.

It is possible that rearwardly extending stays may be employed additional to the bridge structure to further increase the resistance to vehicle movement. These stays may be retractable or removable and are preferably also hydraulically operated.

Figure 3:
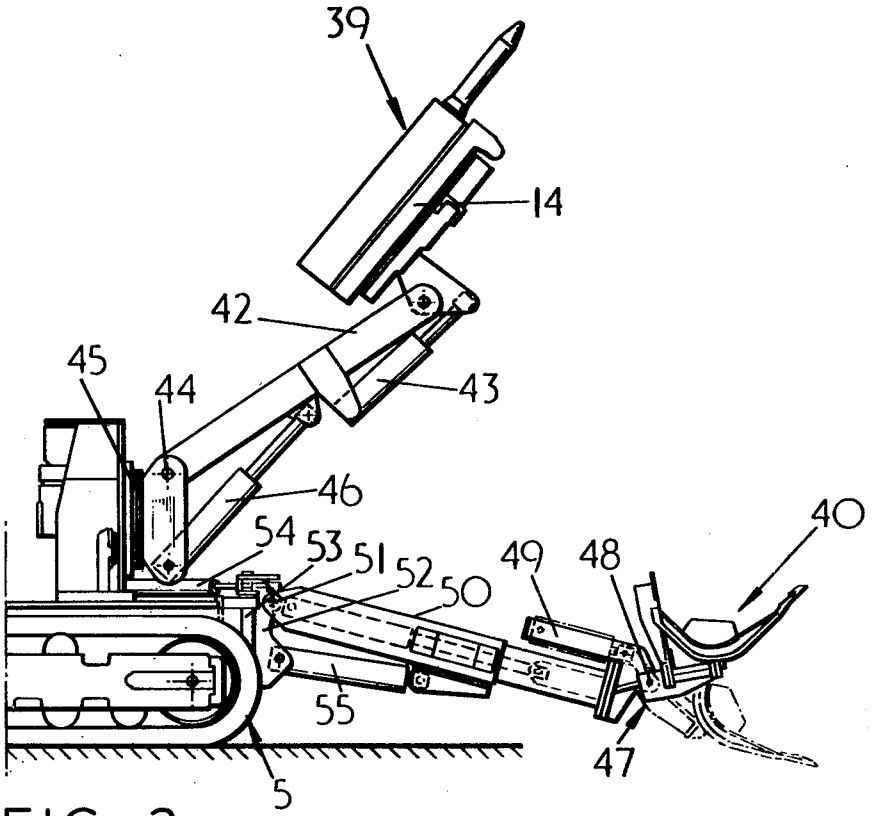
FIG. 3 is a fragmentary view showing two other tools which may be used with the machine.

Two alternative tools are shown in FIG. 3, namely a hydraulic hammer or impactor 39 and side discharge bucket 40.

The hammer 39 is carried on a platform 41 pivoted on a boom 42, a hydraulic ram 43 between the platform 41 and boom permitting relative pivotting thereof. The boom 42 is pivotally mounted at 44 on a vertical turntable 45 and a hydraulic ram 46 interconnects the latter and the boom 42.

The bucket 40 is pivotally carried on a lever structure 47 and is pivotal about a horizontal axis 48 by a hydraulic ram 49 as can be seen. The bucket 40 is also pivotal, as is well known, so that one end is raised above the other for tipping. The lever structure 47 is carried on an extensible boom 50 pivoted at 51 on a bracket 52 movable about a vertical spindle 53 under the action of a hydraulic ram 54 to effect lateral movements of the bucket 40. Another hydraulic ram 55 between the bracket 52 and boom 50 effects extension or retraction of the latter.

Again these tools and their operation are well-known to those skilled in the art and will not be described further.

Profiling tools such as laser guns or electron beam guns may also be used with the present invention.

What is claimed is:

1. A mobile earth working machine for use underground in mines or for tunnelling, comprising:

(a) a tracked vehicle, (b) at least two separate and independently operable earth working tools mounted on the tracked vehicle, (c) means for separately moving and actuating each earth working tool, (d) a bridge structure pivotally mounted on the tracked vehicle towards the rear thereof and including a crossbar, (e) means for pivoting the bridge structure from a substantially horizontal out-of-use position to an upright in-use position, and vice versa, (f) clamping plate means carried by the crossbar of the bridge structure, and (g) means for urging the clamping plate means against a mine or tunnel roof when the bridge structure is in an upright position.

2. A machine as claimed in claim 1, wherein the clamping plate means and urging means comprises a pair of side-by-side pressure clamping plates each carried by a hydraulic ram supported on the crossbar of the bridge structure.

3. A machine as claimed in claim 2, further comprising, between the tracked vehicle drive and the hydraulic rams of the bridge structure, an interlock to permit operation of said rams only when the vehicle is stationary and braked.

4. A machine as claimed in claim 3, wherein the earth working tools are selected from the group comprising a boom-mounted drill, a boom-mounted hammer or impactor, a front discharge bucket, a side discharge bucket, a roof support handling tool and a profiling tool.

5. A machine as claimed in claim 1, wherein the clamping plate means is additionally used to post-stress or load a roof supporting arch or similar structure against a tunnel or mine roof to ensure permanent contact therewith.

* * * * *